US008922450B2

(12) United States Patent
Chen et al.

(10) Patent No.: US 8,922,450 B2
(45) Date of Patent: Dec. 30, 2014

(54) SIGNAL CONVERTING CIRCUIT CAPABLE OF REDUCING/AVOIDING SIGNAL LEAKAGE AND RELATED SIGNAL CONVERTING METHOD

(75) Inventors: Hsien-Ku Chen, Taoyuan County (TW); Chia-Jun Chang, Taipei (TW); Ka-Un Chan, Hsinchu County (TW); Ying-Hsi Lin, Hsin-Chu (TW)

(73) Assignee: Realtek Semiconductor Corp., Science Park, HsinChu (TW)

( * ) Notice: Subject to any disclaimer, the term of this patent is extended or adjusted under 35 U.S.C. 154(b) by 317 days.

(21) Appl. No.: 13/612,851

(22) Filed: Sep. 13, 2012

(65) Prior Publication Data

US 2014/0049441 A1 Feb. 20, 2014

(30) Foreign Application Priority Data

Aug. 15, 2012 (TW) ..... 101129479 A

(51) Int. Cl.
*H01Q 1/50* (2006.01)

(52) U.S. Cl.
USPC ..... 343/859

(58) Field of Classification Search
CPC ..... H01Q 9/16; H01Q 1/242; H01Q 5/0072; H01Q 9/28
USPC ..... 343/859, 821; 370/466, 229; 333/25
See application file for complete search history.

(56) References Cited

U.S. PATENT DOCUMENTS

| | | | | |
|---|---|---|---|---|
| 6,982,609 | B1 * | 1/2006 | McKay et al. | 333/25 |
| 7,199,679 | B2 * | 4/2007 | Mondal | 333/25 |
| 7,944,322 | B2 * | 5/2011 | Roufoogaran | 333/25 |
| 8,283,992 | B2 * | 10/2012 | McKay et al. | 333/26 |
| 8,598,964 | B2 * | 12/2013 | Podell | 333/26 |

* cited by examiner

*Primary Examiner* — Huedung Mancuso
(74) *Attorney, Agent, or Firm* — Winston Hsu; Scott Margo

(57) ABSTRACT

A signal converting circuit includes: a first switching circuit; a second switching circuit; and a first balance-unbalance circuit (Balun) having a first signal terminal coupled to an antenna, a second signal terminal coupled to the first switching circuit, and a third signal terminal coupled to the second switching circuit; wherein when the first balance-unbalance circuit operates in a first signal converting mode, the first switching circuit and the second switching circuit are arranged to couple the second signal terminal and the third signal terminal, respectively, to a first signal processing circuit, and when the first balance-unbalance circuit does not operate in the first signal converting mode, the first switching circuit and the second switching circuit are arranged to couple the second signal terminal and the third signal terminal, respectively, to a reference voltage.

15 Claims, 4 Drawing Sheets

SIGNAL CONVERTING CIRCUIT CAPABLE OF REDUCING/AVOIDING SIGNAL LEAKAGE AND RELATED SIGNAL CONVERTING METHOD

BACKGROUND OF THE INVENTION

1. Field of the Invention

The disclosed embodiments of the present invention relate to a signal converting circuit and a signal converging method, and more particularly, to a circuit and a related method which could solve the signal leakage issue of a signal converting circuit with a lower cost.

2. Description of the Prior Art

In a wireless communication system, a transmission/receiving switching circuit (T/R Switch) is arranged to couple an antenna to a transmission circuit or a receiving circuit, selectively. When the T/R Switch couples the antenna to a transmission circuit, the transmission circuit then generates a transmission signal to the antenna to transmit the transmission signal. When the T/R Switch couples the antenna to a receiving circuit, the receiving circuit then receives a receiving signal from the antenna. However, when the T/R Switch couples the antenna to the receiving circuit to receive the receiving signal, the receiving circuit may receive the signal leakage from the transmission circuit, and therefore the accuracy of the receiving signal would be affected. Furthermore, the cause of the above issues is the poor signal isolation of the T/R Switch. Thus, how to solve the signal leakage issue of a wireless front end circuit with a lower cost has become a topic in the field of a wireless communication system.

SUMMARY OF THE INVENTION

Therefore, one of the objectives of the present invention is to provide a signal converting circuit and a related method to solve the signal leakage issue with a lower cost.

According to a first aspect of the present invention, an exemplary signal converting circuit is disclosed. The signal converting circuit includes a first switching circuit, a second switching circuit and a first balance-unbalance circuit (Balun). The first balance-unbalance circuit has a first signal terminal coupled to an antenna, a second signal terminal coupled to the first switching circuit, and a third signal terminal coupled to the second switching circuit. When the first balance-unbalance circuit operates in a first signal converting mode, the first switching circuit and the second switching circuit are arranged to couple the second signal terminal and the third signal terminal, respectively, to a first signal processing circuit, and when the first balance-unbalance circuit does not operate in the first signal converting mode, the first switching circuit and the second switching circuit are arranged to couple the second signal terminal and the third signal terminal, respectively, to a reference voltage.

According to a second aspect of the present invention, an exemplary signal converting method is disclosed. The method includes: providing a first switching circuit; providing a second switching circuit; providing a first balance-unbalance circuit (Balun), which has a first signal terminal coupled to an antenna, a second signal terminal coupled to the first switching circuit, and a third signal terminal coupled to the second switching circuit; when the first balance-unbalance circuit operates in a first signal converting mode, coupling the second signal terminal and the third signal terminal, respectively, to a first signal processing circuit by using the first switching circuit and the second switching circuit; and when the first balance-unbalance circuit does not operate in the first signal converting mode, coupling the second signal terminal and the third signal terminal, respectively, to a reference voltage by using the first switching circuit and the second switching circuit.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
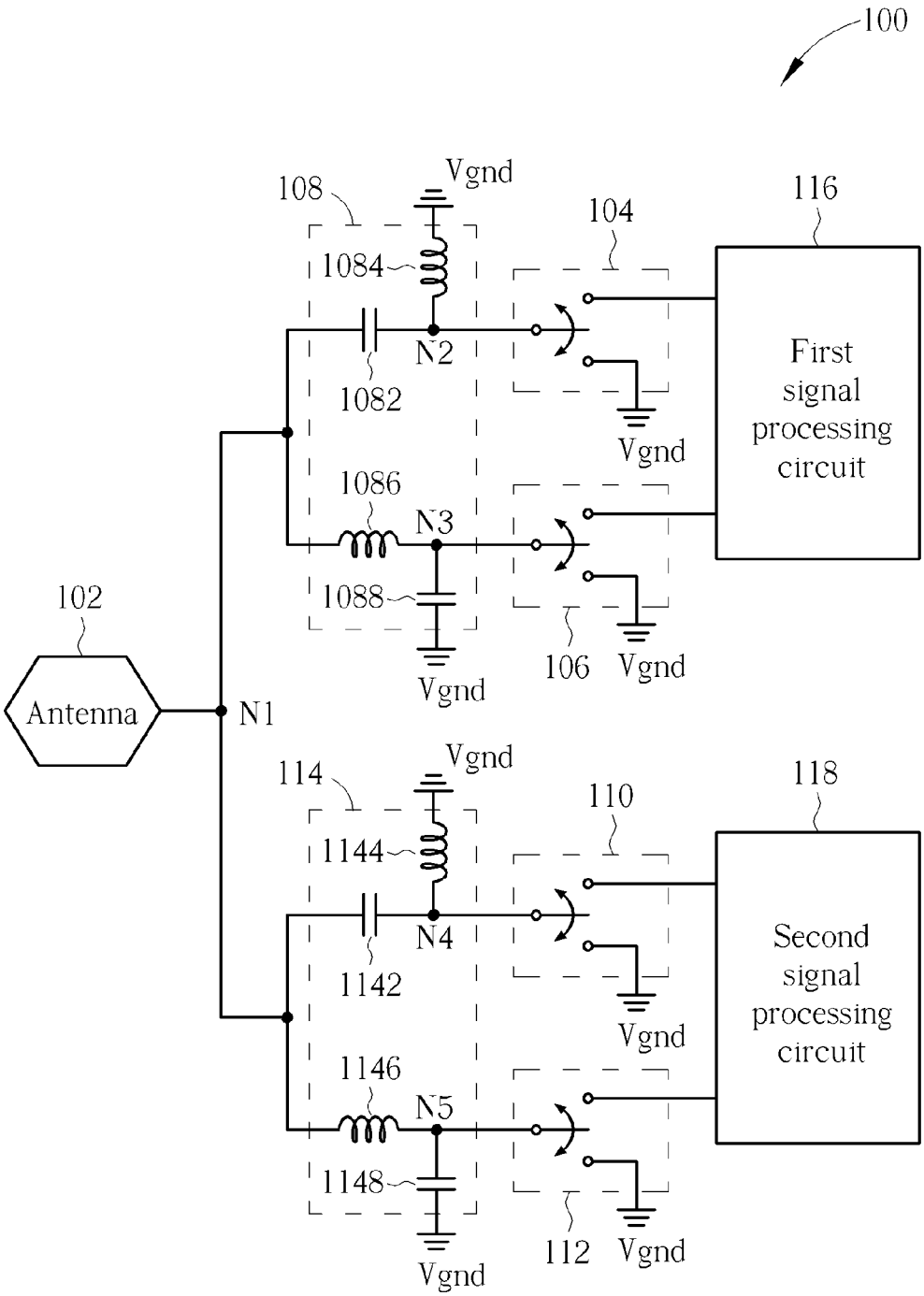
FIG. 1 is a diagram illustrating a signal converting circuit according to an exemplary embodiment of the present invention.

Please refer to FIG. 1, which is a diagram illustrating a signal converting circuit 100 according to an exemplary embodiment of the present invention. The signal converting circuit 100 may be employed in a front end circuit of a wireless communication system, and thus the signal converting circuit 100 could be coupled to an antenna 102. In this embodiment, the exemplary signal converting circuit 100 includes a first switching circuit 104, a second switching circuit 106, a first balance-unbalance circuit (Balun) 108, a third switching circuit 110, a fourth switching circuit 112 and a second balance-unbalance circuit 114. The first balance-unbalance circuit 108 has a first signal terminal N1 coupled to the antenna 102, a second signal terminal N2 coupled to the first switching circuit 104, and a third signal terminal N3 coupled to the second switching circuit 106. The second balance-unbalance circuit 114 has a first signal terminal coupled to the antenna 102, a second signal terminal N4 coupled to the third switching circuit 110, and a third signal terminal N5 coupled to the fourth switching circuit 112.

In accordance with this embodiment, when the first balance-unbalance circuit 108 operates in a first signal converting mode, the first switching circuit 104 and the second switching circuit 106 are arranged to couple the second signal terminal N2 and the third signal terminal N3, respectively, to a first signal processing circuit 116; and when the first balance-unbalance circuit 108 does not operate in the first signal converting mode, the first switching circuit 104 and the second switching circuit 106 are arranged to couple the second signal terminal N2 and the third signal terminal N3, respectively, to a reference voltage (i.e., a ground voltage Vgnd). And, when the second balance-unbalance circuit 114 operates in a second signal converting mode, the third switching circuit 110 and the fourth switching circuit 112 are arranged to couple the second signal terminal N4 and the third signal terminal N5 of the second balance-unbalance circuit 114, respectively, to a second signal processing circuit 118; and when the second balance-unbalance circuit 114 does not operate in the second signal converting mode, the third switching circuit 110 and the fourth switching circuit 112 are arranged to couple the second signal terminal N4 and the third signal terminal N5 of the second balance-unbalance circuit 114, respectively, to the reference voltage (i.e., a ground voltage Vgnd). It should be noted that, in this exemplary embodiment, the first signal converting mode could be a signal receiving mode of the wireless communication system, and the second signal converting mode could be a signal transmission mode of the wireless communication system. Thus, the first signal processing 116 may be a receiving circuit in the wireless communication system, and the second signal processing circuit 118 may be a transmission circuit in the wireless communication system.

In addition, in this exemplary embodiment, the first signal terminal N1 of the first balance-unbalance circuit 108 and the first signal terminal (N1) of the second balance-unbalance circuit 114 are connected to the antenna 102 directly. In other words, there is no transmission/receiving switching circuit (T/R Switch) disposed in between the first balance-unbalance circuit 108, the second balance-unbalance circuit 114 and the antenna 102 to switch the antenna 102 to connect to the first balance-unbalance circuit 108 or the second balance-unbalance circuit 114. Therefore, the RF front end circuit of the present embodiment could save at least a T/R Switch. In another aspect, to reduce the area of the RF front end circuit of the present embodiment for further reducing the production cost of the RF front end circuit, the first, the second, the third, the fourth switching circuits 104, 106, 110, 112, the first balance-unbalance circuit 108 and the second balance-unbalance circuit 114 are all disposed in the same chip. In another exemplary embodiment, the first, the second, the third, the fourth switching circuits 104, 106, 110, 112, the first balance-unbalance circuit 108, the second balance-unbalance circuit 114, the first signal processing circuit 116, and the second signal processing circuit 118 are all disposed in the same chip, and this also belongs to the scope of the present invention.

According to the embodiment of the present, the first balance-unbalance circuit 108 includes a first capacitor 1082, a first inductor 1084, a second inductor 1086, and a second capacitor 1088. The first capacitor 1082 has a first terminal (i.e., N1) coupled to the antenna 102. The first inductor 1084 has a first terminal coupled to the reference voltage (i.e., the ground voltage Vgnd), and a second terminal (i.e., N2) coupled to the second terminal (i.e., N2) of the first capacitor 1082 and the first switching circuit 104. The second inductor 1086 has a first terminal (i.e., N1) coupled to the antenna 102. The second capacitor 1088 has a first terminal coupled to the reference voltage (i.e., the ground voltage Vgnd), and a second terminal (i.e., N3) coupled to the second terminal (i.e., N3) of the second inductor 1086 and the second switching circuit 106.

In addition, the second balance-unbalance circuit 114 includes a first capacitor 1142, a first inductor 1144, a second inductor 1146, and a second capacitor 1148. The first capacitor 1142 has a first terminal (i.e., N1) coupled to the antenna 102. The first inductor 1144 has a first terminal coupled to the reference voltage (i.e., the ground voltage Vgnd), and a second terminal (i.e., N4) coupled to the second terminal (i.e., N4) of the first capacitor 1142 and the third switching circuit 110. The second inductor 1146 has a first terminal (i.e., N1) coupled to the antenna 102. The second capacitor 1148 has a first terminal coupled to the reference voltage (i.e., the ground voltage Vgnd), and a second terminal (i.e., N5) coupled to the second terminal (i.e., N5) of the second inductor 1146 and the fourth switching circuit 112.

In this embodiment, to make a resonance frequency F1 resulting from the first capacitor 1082 and the first inductor 1084 substantially equal to a resonance frequency F2 resulting from the second capacitor 1088 and the second inductor 1086, a capacitance value C1 of the first capacitor 1082 and an inductance value L1 of the first inductor 1084 may be substantially equal to a capacitance value C2 of the first capacitor 1088 and an inductance value L2 of the first inductor 1086, respectively. Similarly, to make a resonance frequency F3 resulting from the first capacitor 1142 and the first inductor 1144 substantially equal to a resonance frequency F4 resulting from the second capacitor 1148 and the second inductor 1146, a capacitance value C3 of the first capacitor 1142 and an inductance value L3 of the first inductor 1084 may be substantially equal to a capacitance value C4 of the first capacitor 1148 and an inductance value L4 of the first inductor 1146, respectively. Please note that the above-mentioned examples are not meant to be limitations of the present invention. Actually, any design methodology would fall within the scope of the present invention as ling as the design methodology could make a product of the capacitance value C1 of the first capacitor 1082 and the inductance value L1 of the first inductor 1084 substantially equal to the product of the capacitance value C2 of the first capacitor 1088 and the inductance value L2 of the first inductor 1086, and/or make a product of the capacitance value C3 of the first capacitor 1142 and the inductance value L3 of the first inductor 1084 substantially equal to the product of the capacitance value C4 of the first capacitor 1148 and the inductance value L4 of the first inductor 1146.

The capacitance values C1, C2, C3 and C4 are substantially equal to each other in this embodiment, and could be expressed as C for brevity; the inductance values L1, L2, L3 and L4 are substantially equal to each other, and could be expressed as L. Thus, the resonance frequencies F1, F2, F3, F4 are substantially equal to each other, and could be expressed as F. The resonance frequency F could be expressed by the following equation (1):

$$F = \frac{1}{\sqrt{L * C}}, \tag{1}$$

The resonance frequency F may be designed as the signal frequency of a receiving signal and a transmission signal of the wireless communication system of the present invention.

Figure 2:
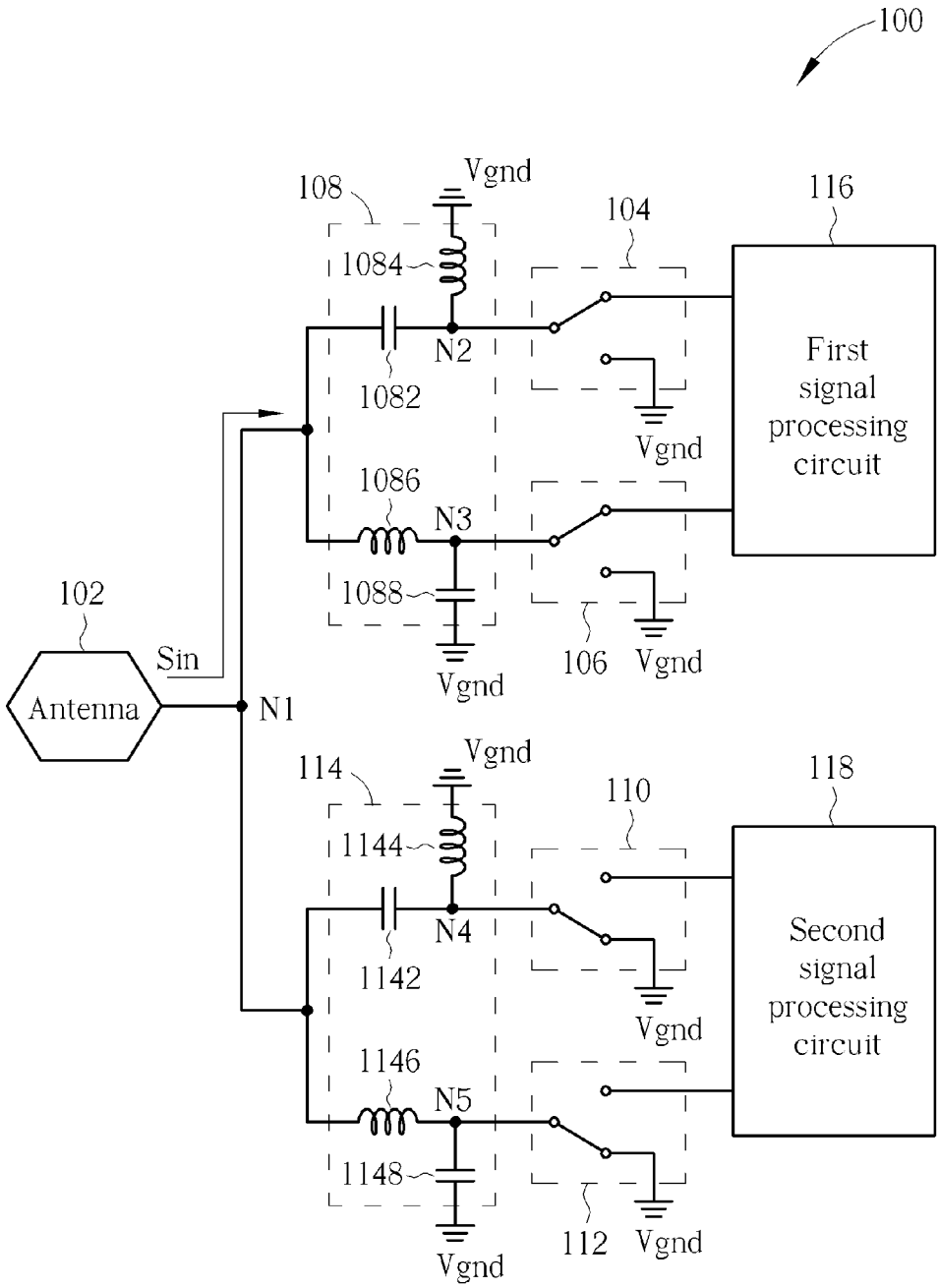
FIG. 2 is a diagram illustrating the signal converting circuit operating in the signal receiving mode according to an embodiment of the present invention.

Thus, when the signal converting circuit 100 operates in the signal receiving mode (i.e., the first signal converting mode), the third switching circuit 110 and the fourth switching circuit 112 would couple the second signal terminal N4 and the third signal terminal N5 of the second balance-unbalance circuit 114 to the ground voltage Vgnd, as shown in FIG. 2. FIG. 2 is a diagram illustrating the signal converting circuit 100 operating in the signal receiving mode according to an embodiment of the present invention. When the common connection terminal N4 of the first inductor 1142 and the first capacitor 1144 and the common connection terminal N5 of the second inductor 1146 and the second capacitor 1148 are both connected to the ground voltage Vgnd, the first capacitor 1142 and the first inductor 1144 form a band-stop filter, and the second inductor 1146 and the second capacitor 1148 form another band-stop filter. In other words, as to the terminal N1, when the signal converting circuit 100 operates in the signal receiving mode, the two aforementioned band-stop filters could be regarded as open circuits equivalently. Therefore, when the signal converting circuit 100 operates in the signal receiving mode, the terminal N1 could be isolated from the transmission circuit (i.e., the second signal processing circuit 118) effectively, thus protecting the receiving signal Sin from being affected by the transmission circuit and preventing the receiving signal Sin from leaking to the transmission circuit.

Figure 3:
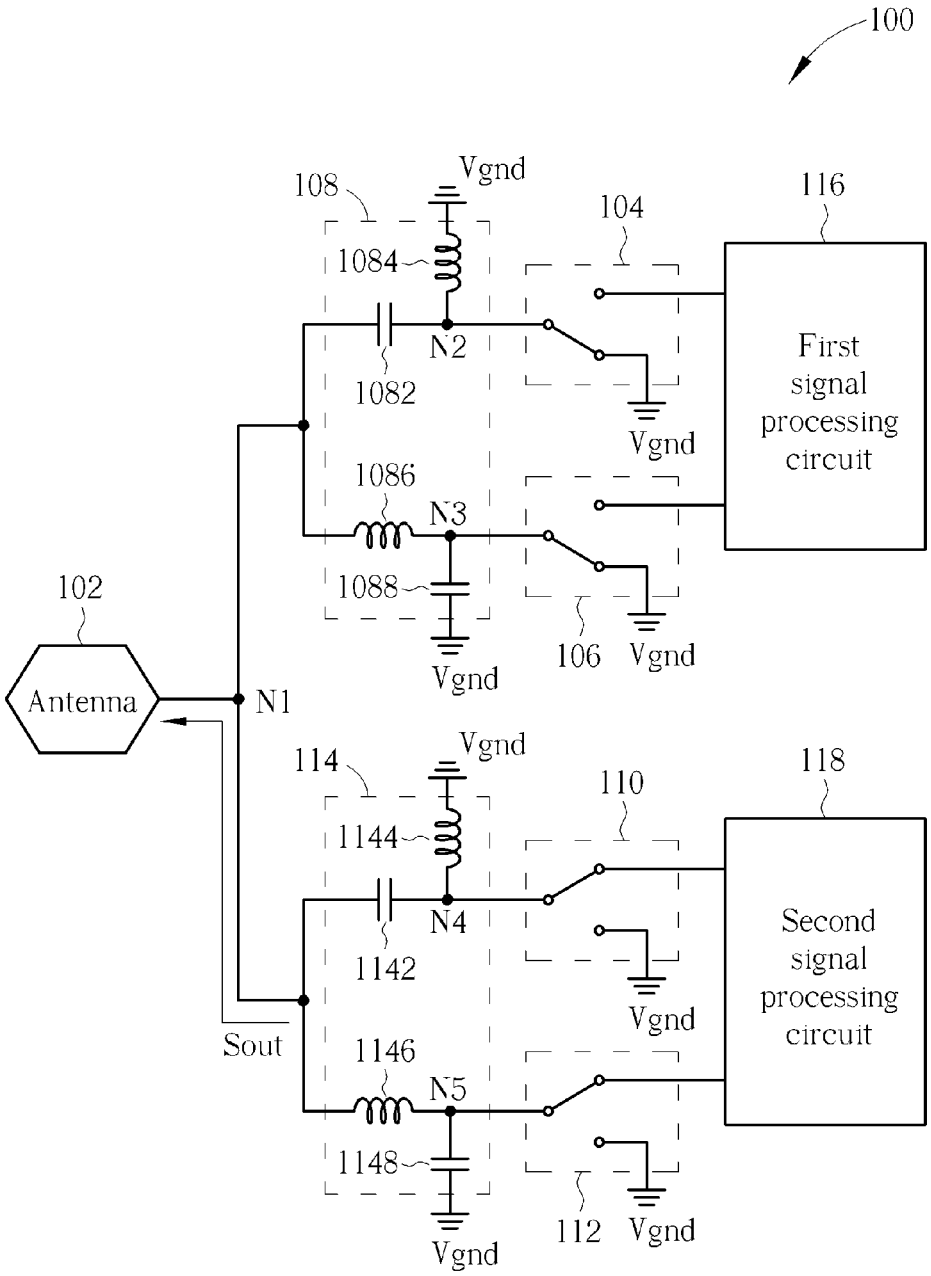
FIG. 3 is a diagram illustrating the signal converting circuit operating in the signal transmission mode according to an embodiment of the present invention.

On the contrary, when the signal converting circuit 100 operates in the signal transmission mode (i.e., the second signal converting mode), the first switching circuit 104 and the second switching circuit 106 would couple the second signal terminal N2 and the third signal terminal N3 of the first balance-unbalance circuit to the ground voltage Vgnd respectively, as shown in FIG. 3. FIG. 3 is a diagram illustrating the signal converting circuit 100 operating in the signal transmission mode according to an embodiment of the present invention. When the common connection terminal N2 of the first capacitor 1082 and the first inductor 1084 and the common connection terminal N3 of the second inductor 1086 and the second capacitor 1088 are both connected to the ground voltage Vgnd, the first capacitor 1082 and the first inductor 1084 form a band-stop filter, and the second inductor 1086 and the second capacitor 1088 form another band-stop filter, wherein the two band-stop filters would filter out the signal with a signal frequency F. To put it another way, as to the terminal N1, when the signal converting circuit 100 operates in the signal transmission mode, the two aforementioned band-stop filters could be regarded as open circuits equivalently. Therefore, when the signal converting circuit 100 operates in the signal transmission mode, the receiving circuit (i.e., the first signal processing circuit 116) could be isolated from the terminal N1 effectively, thus preventing the transmission signal Sout from leaking to the receiving circuit, and protecting the transmission signal Sout from being affected by the signal of the receiving circuit.

It should be noted that, in this embodiment, the first signal processing circuit 116 is a differential receiving circuit, and the second signal processing circuit 118 is a differential transmission circuit. Hence, the first signal processing circuit 116 would have two signal terminals (i.e., + and −) coupled to the first switching circuit 104 and the second switching circuit 106, respectively, to thereby receive the differential receiving signals from the first balance-unbalance converting 108. The second signal processing circuit 118 would have two signal terminals (i.e., + and −) coupled to the third switching circuit 110 and the fourth switching circuit 112, respectively, to thereby transmit the differential receiving signals to the second balance-unbalance converting 114.

It should be noted that the proposed methods of the present invention are not limited to being employed in a differential transceiver system simultaneously. A proposed method may be solely employed in either a differential receiving circuit or a differential transmission circuit. For instance, when the switching method is solely employed in a differential receiving circuit, if the differential receiving circuit operates in a signal receiving mode, a first switching circuit and a second switching circuit (which could be analogous to the first switching circuit 104 and the second switching circuit 106 shown in FIG. 1) would couple two signal terminals of a balance-unbalance converting (which could be analogous to the first balance-unbalance circuit 108 shown in FIG. 1) to a receiving circuit (which could be analogous to the first signal processing circuit 116 shown in FIG. 1) to receive a receiving signal from an antenna. If the differential receiving circuit does not operate in the signal receiving mode, the first switching circuit and the second switching circuit (which could be analogous to the first switching circuit 104 and the second switching circuit 106 shown in FIG. 1) would couple the two signal terminals of the balance-unbalance converting (which could be analogous to the first balance-unbalance circuit 108 shown in FIG. 1) to a ground voltage to isolate the receiving circuit from the antenna effectively. The details would be omitted here for brevity due to that the operating principle is similar to that of the receiving circuit part of the signal converting circuit 100 in FIG. 1.

In another example, when the switching method is solely employed in a differential transmission circuit, if the differential receiving circuit operates in a signal transmission mode, a first switching circuit and a second switching circuit (which could be analogous to the third switching circuit 110 and the fourth switching circuit 112 shown in FIG. 1) would couple two signal terminals of a balance-unbalance converting (which could be analogous to the second balance-unbalance circuit 114 shown in FIG. 1) to a transmission circuit (which could be analogous to the second signal processing circuit 118 shown in FIG. 1) to transmit a transmission signal to an antenna. If the differential transmission circuit does not operate in the signal transmission mode, the first switching circuit and the second switching circuit (which could be analogous to the third switching circuit 110 and the fourth switching circuit 112 shown in FIG. 1) would couple the two signal terminals of the balance-unbalance converting (which could be analogous to the second balance-unbalance circuit 114 shown in FIG. 1) to a ground voltage to isolate the transmission circuit from the antenna effectively. The details would be omitted here for brevity due to that the operating principle is similar to that of the transmission circuit part of the signal converting circuit 100 in FIG. 1.

Figure 4:
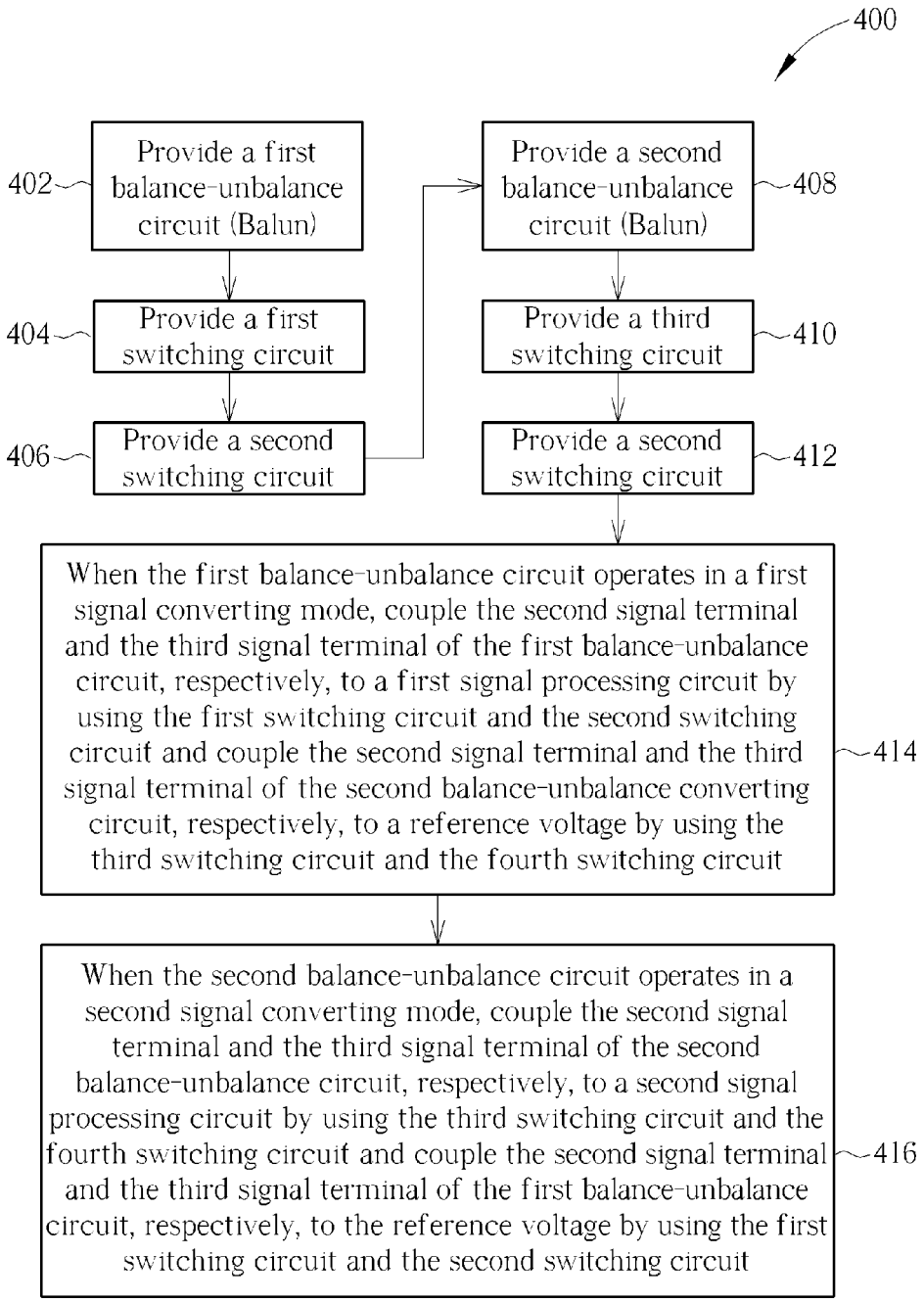
FIG. 4 is a flowchart illustrating a signal converting method according to an exemplary embodiment of the present invention.

The above-mentioned method of the signal converting circuit 100 may be summarized using the following steps 402-410, as shown in FIG. 4. FIG. 4 is a flowchart illustrating a signal converting method 400 according to an exemplary embodiment of the present invention. Provided that substantially the same result is achieved, the steps of the flowchart shown in FIG. 4 need not be in the exact order shown and need not be contiguous, that is, other steps can be intermediate. Besides, some steps in FIG. 4 may be omitted according to various types of embodiments or requirements. The signal converting method 400 includes:

Step 402: Provide a first balance-unbalance circuit (Balun) which has a first signal terminal coupled to an antenna;

Step 404: Provide a first switching circuit coupled to a second signal terminal of the first balance-unbalance circuit;

Step 406: Provide a second switching circuit coupled to a third signal terminal of the first balance-unbalance circuit;

Step 408: Provide a second balance-unbalance circuit (Balun) which has a first signal terminal coupled to an antenna;

Step 410: Provide a third switching circuit coupled to a second signal terminal of the second balance-unbalance circuit;

Step 412: Provide a second switching circuit coupled to a third signal terminal of the second balance-unbalance circuit;

Step 414: When the first balance-unbalance circuit operates in a first signal converting mode, couple the second signal terminal and the third signal terminal of the first balance-unbalance circuit, respectively, to a first signal processing circuit by using the first switching circuit and the second switching circuit; and couple the second signal terminal and the third signal terminal of the second balance-unbalance converting circuit, respectively, to a reference voltage by using the third switching circuit and the fourth switching circuit; and Step 416: When the second balance-unbalance circuit operates in a second signal converting mode, couple the second signal terminal and the third signal terminal of the second balance-unbalance circuit, respectively, to a second signal processing circuit by using the third switching circuit and the fourth switching circuit; and couple the second signal terminal and the third signal terminal of the first balance-unbalance circuit, respectively, to the reference voltage by using the first switching circuit and the second switching circuit.

Please refer to FIG. 4 in conjunction with FIG. 1. According to the step 414 of the signal converting method 400 of the present invention, when an RF front end circuit of the wireless communication system operates in a signal receiving mode (i.e., the first signal converting mode), the third switching circuit 110 and the fourth switching circuit 112 would couple the second signal terminal N4 and the third signal terminal N5 of the second balance-unbalance converting circuit 114 to the ground voltage Vgnd. Therefore, the terminal N1 could be isolated from the second signal processing circuit (i.e., the transmission circuit) effectively, thus protecting the receiving signal Sin of the RF front end circuit from being affected by the transmission circuit, and preventing the receiving signal Sin from leaking to the transmission circuit.

In addition, according to the step 416 of the signal converting method 400 of the embodiment, when the RF front end circuit operates in a signal transmission mode (i.e., the second signal converting mode), the first switching circuit 104 and the second switching circuit 106 would couple the second signal terminal N2 and the third signal terminal N3 of the first balance-unbalance converting circuit 108 to the ground voltage, Vgnd. Therefore, the first signal processing circuit (i.e., the receiving circuit) would be isolated from the terminal N1 effectively, this preventing the transmission signal Sout from leaking to the receiving circuit, and protecting the transmission signal Sout from being affected by the signal of the receiving circuit.

In conclusion, the present invention places the first switching circuit 104 and the second switching circuit 106 in between the first balance-unbalance converting circuit 108 and the receiving circuit 116, places the third switching circuit 110 and the fourth switching circuit 112 in between the second balance-unbalance converting circuit 114 and the transmission circuit 118, and controls the first switching circuit 104, the second switching circuit 106, the third switching circuit 110 and the fourth switching circuit 112 properly to use the electrical characteristics of the first balance-unbalance converting circuit 108 and the second balance-unbalance converting circuit 114 to effectively provide signal isolation between the receiving circuit 116 and the transmission circuit 118. Therefore, the RF front end circuit of the embodiments of the present invention saves at least the cost of an external transmission/receiving circuit by using the above-mentioned method(s).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A signal converting circuit, comprising:

a first switching circuit;

a second switching circuit; and a first balance-unbalance circuit (Balun), having a first signal terminal coupled to an antenna, a second signal terminal coupled to the first switching circuit, and a third signal terminal coupled to the second switching circuit;

wherein when the first balance-unbalance circuit operates in a first signal converting mode, the first switching circuit and the second switching circuit are arranged to couple the second signal terminal and the third signal terminal, respectively, to a first signal processing circuit, and when the first balance-unbalance circuit does not operate in the first signal converting mode, the first switching circuit and the second switching circuit are arranged to couple the second signal terminal and the third signal terminal, respectively, to a reference voltage.

2. The signal converting circuit of claim 1, wherein the first signal terminal of the first balance-unbalance circuit is directly connected to the antenna.

3. The signal converting circuit of claim 1, wherein the first signal processing circuit is a transmission circuit or a receiving circuit.

4. The signal converting circuit of claim 1, wherein the first balance-unbalance circuit comprises:

a first capacitor, having a first terminal coupled to the antenna;

a first inductor, having a first terminal coupled to the reference voltage, and a second terminal coupled to a second terminal of the first capacitor and the first switching circuit;

a second inductor, having a first terminal coupled to the antenna; and a second capacitor, having a first terminal coupled to the reference voltage, and a second terminal coupled to a second terminal of the second inductor and the second switching circuit.

5. The signal converting circuit of claim 1, wherein a first resonance frequency resulting from the first capacitor and the first inductor is substantially equal to a second resonance frequency resulting from the second capacitor and the second inductor.

6. The signal converting circuit of claim 4, wherein a first capacitance value of the first capacitor and a first inductance value of the first inductor are substantially equal to a second capacitance value of the second capacitor and a second inductance value of the second inductor, respectively.

7. The signal converting circuit of claim 1, wherein the first switching circuit, the second switching circuit and the first balance-unbalance circuit are disposed in a same chip.

8. The signal converting circuit of claim 1, further comprising:

a third switching circuit;

a fourth switching circuit; and a second balance-unbalance circuit (Balun), having a first signal terminal coupled to the antenna, a second signal terminal coupled to the third switching circuit, and a third signal terminal coupled to the fourth switching circuit;

wherein when the second balance-unbalance circuit operates in a second signal converting mode, the third switching circuit and the fourth switching circuit are arranged to couple the second signal terminal and the third signal terminal of the second balance-unbalance circuit, respectively, to a second signal processing circuit, and when the second balance-unbalance circuit does not operate in the second signal converting mode, the third switching circuit and the fourth switching circuit are arranged to couple the second signal terminal and the third signal terminal of the second balance-unbalance circuit, respectively, to the reference voltage.

9. The signal converting circuit of claim 8, wherein when the first balance-unbalance circuit operates in the first signal converting mode, the second balance-unbalance circuit does not operate in the second signal converting mode, and when the second balance-unbalance circuit operates in the second signal converting mode, the first balance-unbalance circuit does not operate in the first signal converting mode.

10. The signal converting circuit of claim 8, wherein the first signal terminal of the first balance-unbalance circuit is directly connected to the antenna, and the first signal terminal of the second balance-unbalance circuit is directly connected to the antenna.

11. The signal converting circuit of claim 8, wherein the first signal processing circuit is a transmission circuit, and the second signal processing circuit is a receiving circuit.

12. The signal converting circuit of claim 8, wherein the first switching circuit, the second switching circuit, the third switching circuit, the fourth switching circuit, the first balance-unbalance circuit and the second balance-unbalance circuit are disposed in a same chip.

13. A signal converting method, comprising:

providing a first switching circuit;

providing a second switching circuit;

providing a first balance-unbalance circuit (Balun), having a first signal terminal coupled to an antenna, a second signal terminal coupled to the first switching circuit, and a third signal terminal coupled to the second switching circuit;

when the first balance-unbalance circuit operates in a first signal converting mode, coupling the second signal terminal and the third signal terminal, respectively, to a first signal processing circuit by using the first switching circuit and the second switching circuit; and when the first balance-unbalance circuit does not operate in the first signal converting mode, coupling the second signal terminal and the third signal terminal, respectively, to a reference voltage by using the first switching circuit and the second switching circuit.

14. The signal converting method of claim 13, further comprising:

providing a third switching circuit;

providing a fourth switching circuit; and providing a second balance-unbalance circuit (Balun), having a first signal terminal coupled to the antenna, a second signal terminal coupled to the third switching circuit, and a third signal terminal coupled to the fourth switching circuit;

when the second balance-unbalance circuit operates in a second signal converting mode, coupling the second signal terminal and the third signal terminal of the second balance-unbalance circuit, respectively, to a second signal processing circuit by using the third switching circuit and the fourth switching circuit; and when the second balance-unbalance circuit does not operate in the second signal converting mode, coupling the second signal terminal and the third signal terminal of the second balance-unbalance circuit, respectively, to the reference voltage by using the third switching circuit and the fourth switching circuit.

15. The signal converting method of claim 14, wherein when the first balance-unbalance circuit operates in the first signal converting mode, the second balance-unbalance circuit does not operate in the second signal converting mode, and when the second balance-unbalance circuit operates in the second signal converting mode, the first balance-unbalance circuit does not operate in the first signal converting mode.

* * * * *